US005882083A

United States Patent [19]

Robinson

[11] Patent Number: 5,882,083

[45] Date of Patent: Mar. 16, 1999

[54] DIALYSIS SEATING UNIT

[76] Inventor: Bonnie A. Robinson, 4230 Tamarack Turn NE., Grand Rapids, Mich. 49505

[21] Appl. No.: 812,271

[22] Filed: Mar. 6, 1997

Related U.S. Application Data

[60] Provisional application No. 60/0111,603, Mar. 8, 1996 and provisional application No. 60/024,008, Aug. 15, 1996.

[51] Int. Cl. [6] ..... A47C 7/00

[52] U.S. Cl. ..... 297/440.2; 297/219.1; 297/118; 297/230.1; 297/229; 297/354.13; 297/423.2; 297/423.26; 297/377; 297/423.27; 5/653

[58] Field of Search ..... 297/440.2, 440.1, 297/344.19, 339, 354.13, 411.36, 411.26, 411.27, 423.26, 423.2, 377, 452.27, 118, DIG. 4, 230.1, 230.12, 230.13, 230.14, 219.1, 228, 228.13, 229, 135; 5/654, 653

[56] References Cited

U.S. PATENT DOCUMENTS

| | | | |
|---|---|---|---|
| 36,441 | 9/1862 | Skinner | 297/354.13 X |
| 338,330 | 3/1886 | Anderson | 297/423.26 X |
| 683,032 | 9/1901 | Franklin | 297/377 X |
| 806,678 | 12/1905 | Kelly | 297/423.2 |
| 834,376 | 10/1906 | Flindall | 297/423.2 X |
| 954,594 | 4/1910 | Shaw . | |
| 956,837 | 5/1910 | Tiedemann et al. . | |
| 979,461 | 12/1910 | Gale | 297/118 |
| 1,349,227 | 8/1920 | Shkor | 297/377 |
| 1,362,444 | 12/1920 | Spector | 297/377 X |
| 1,398,253 | 11/1921 | Blando | 297/377 X |
| 1,419,006 | 6/1922 | Barrett | 297/230.1 |
| 1,530,420 | 3/1925 | Schmitt . | |
| 1,539,443 | 5/1925 | Talmage | 297/423.2 X |
| 1,631,811 | 6/1927 | Guenther . | |
| 2,797,738 | 7/1957 | Patterson | 297/411.36 X |
| 3,215,469 | 11/1965 | Wamsley . | |
| 3,517,963 | 6/1970 | Woods et al. | 297/229 X |
| 3,792,897 | 2/1974 | Alson | 297/219.1 |
| 4,126,355 | 11/1978 | Rosenbeck . | |
| 4,128,272 | 12/1978 | Boyle | 297/219.1 X |
| 4,165,127 | 8/1979 | Vago . | |
| 4,453,732 | 6/1984 | Assanah et al. | 297/118 X |
| 4,691,962 | 9/1987 | Holdt . | |
| 4,717,169 | 1/1988 | Shaffer | 297/354.13 X |
| 4,847,933 | 7/1989 | Bedford | 5/653 X |
| 4,948,197 | 8/1990 | Sansing . | |
| 5,226,188 | 7/1993 | Liou | 5/653 |
| 5,246,265 | 9/1993 | Nagan et al. . | |
| 5,294,181 | 3/1994 | Rose et al. | 297/452.27 X |
| 5,451,092 | 9/1995 | Gray | 297/440.1 X |

FOREIGN PATENT DOCUMENTS

| | | | |
|---|---|---|---|
| 528344 | 3/1957 | Belgium | 297/377 |
| 1101008 | 9/1955 | France | 297/230.1 |
| 2501 | 1/1913 | United Kingdom | 297/118 |
| 168450 | 9/1921 | United Kingdom | 297/423.2 |

*Primary Examiner*—Peter M. Cuomo
*Assistant Examiner*—Rodney B. White

[57] ABSTRACT

A dialysis seating unit has a base that is adapted to receive and support a user; a back support connected with the base, that is adapted to receive and support the user's back; and a pad that is interposed between the user and at least one of the base and the back support. The pad has a grid-pattern array of compartments with alternating compartments being filled with a pad stuffing, to present a checkerboard-like pattern of compartments that have the pad stuffing. In another aspect of the invention, a dialysis seating unit has a back support insert that releasably couples with the back support to effectively narrow the support for a relatively smaller user's back. In yet another aspect of the invention, a dialysis seating unit has a seat insert that releasably couples with the base to effectively narrow the seating area.

20 Claims, 12 Drawing Sheets

DIALYSIS SEATING UNIT

CROSS-REFERENCES TO RELATED APPLICATIONS

This is a continuation in part application of co-pending U.S. Provisional patent application Ser. No. 60/011,603, entitled Dialysis Seating Unit and filed on Mar. 8, 1996, by Bonnie Robinson, the disclosure of which is incorporated here by reference; and a continuation in part application of co-pending U.S. Provisional patent application Ser. No. 60/024,008, entitled Dialysis Seating Unit and filed on Aug. 15, 1996, by Bonnie Robinson, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to a dialysis seating unit to support a dialysis patient during blood dialysis treatment. More particularly, the invention relates to an adjustable seating unit to accommodate patients of different sizes.

Dialysis patients must frequently have blood treatment that involves sitting for extended lengths of time, about four hours for example. Dialysis patients also cover a broad range of age and physical size. Seating that does not accommodate the dialysis patient will result in fidgeting and continuing shifting by the patient to find a comfortable position. Further, skin irritations and sores may actually develop by use of a chair or the like that does not properly accommodate the patient. Thus, accommodating the dialysis patient with a comfortable seating unit is of significant concern.

BRIEF SUMMARY OF THE INVENTION

A dialysis seating unit according to the invention addresses the problems and concerns of dialysis patients, some of which are identified above, with a seating unit that has a base that is adapted to receive and support a user; a back support connected with the base, that is adapted to receive and support the user's back; and a pad that is interposed between the user and at least one of the base and the back support. The pad has a grid-pattern array of compartments with alternating compartments being filled with a pad stuffing, to present a checkerboard-like pattern of compartments that have the pad stuffing.

In another aspect of the invention, a dialysis seating unit has a base; a back support hingedly connected with the base, a back support insert that releasably couples with the back support to effectively narrow the support for a relatively smaller user's back, and a seat insert that releasably couples with the base to effectively narrow the seating area.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
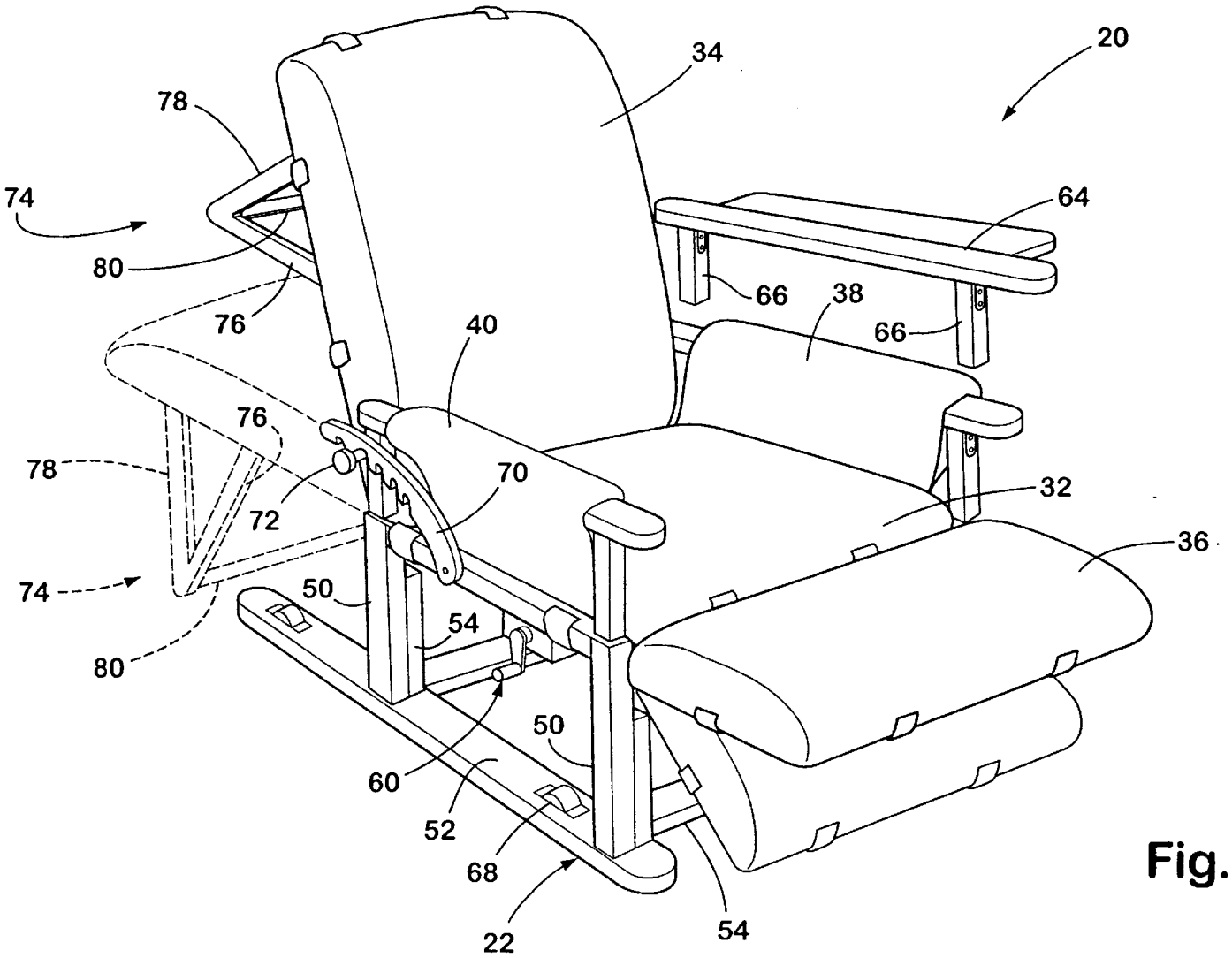
FIG. 1 is a perspective view of a seating unit according to the invention.

A dialysis seating unit 20 according to the invention is generally shown in the drawing FIGS. 1–13. The seating unit 20 includes a base 22 (FIG. 6), a back support 24 connected with the base 22 (FIGS. 2, 3, 8, and 9), a leg rest support 26 connected with the base 22 (FIGS. 2 and 8), removable arm frames 28 and 30 connected with the base 22, a seat pad 32 connected with the base 22, a back pad 34 connected with the back support 24, a leg rest pad 36 connected with the leg rest support 26, and arm pads 38 and 40 connected with the arm frames 28 and 30.

Figure 7:
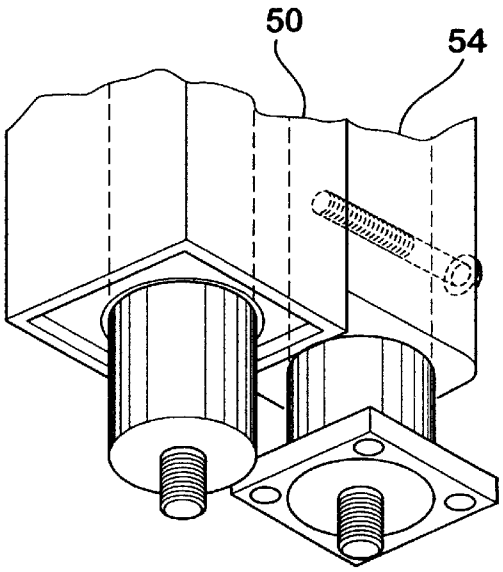
FIG. 7 is an enlarged, fragmentary, perspective view of the detail VII of FIG. 6.
Figure 6:
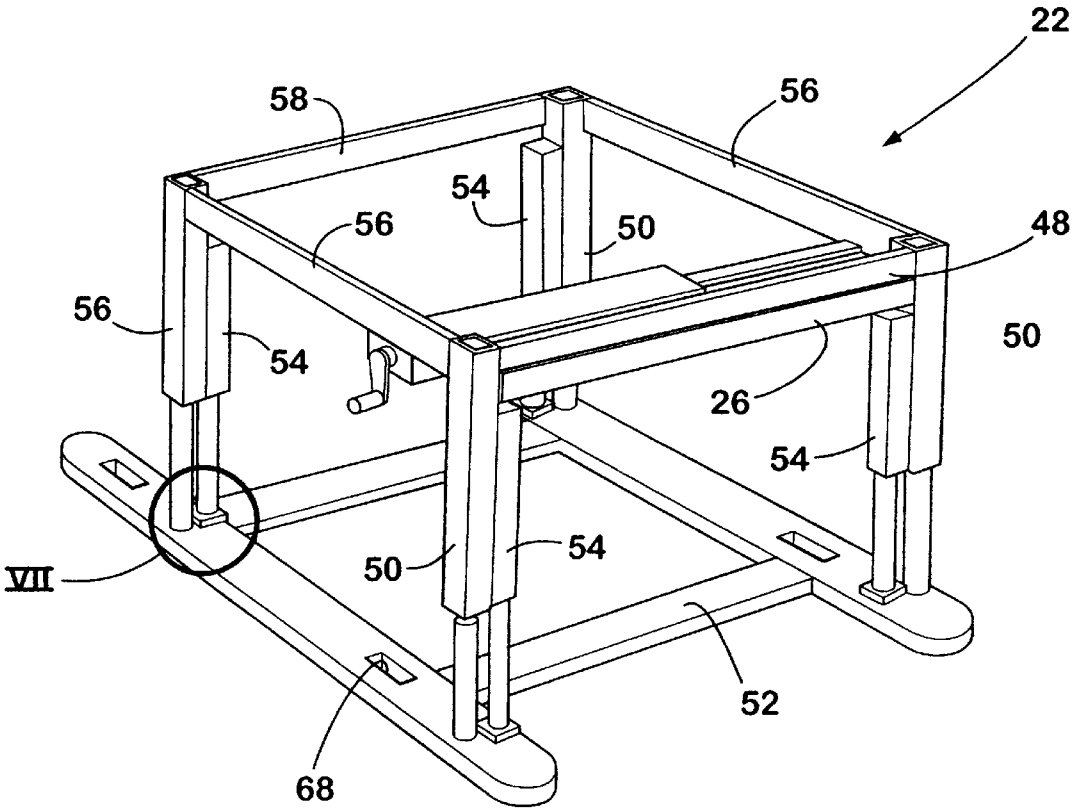
FIG. 6 is a perspective view of the base frame of the seating unit of FIG. 1.

As shown in drawing FIGS. 6 and 7, the base 22 has four telescoping legs 50 that extend generally vertically upward from a base platform 52. An actuating cylinder 54 is located at each leg 50 and connected between the platform 52 and the respective leg 50 as shown in the FIGS. 6 and 7. Horizontal braces 56, and front and back transverse braces 48 and 58, respectively, extend between adjacent legs 50 as is generally shown in the drawing figures.

A pump 60 is mounted under the longitudinal braces 56 and is operatively connected by conventional methods, with tubing and the like, to each of the cylinders 54. The pump 60 and cylinders 54 are standard components that are available from the Suspa Company, through commonly known vendors of hydraulic or pneumatic cylinder equipment. More particularly, each actuating cylinder 54 is preferably provided with a combined piston and rod that has a diameter of about one inch (25.4 mm) and extends up to about eight inches (203 mm) from the closed position. In addition to hydraulic or pneumatic cylinder equipment, commonly known screw jack style cylinders, either power or manually actuated, may also be used, for example.

Each of the legs 50 has an open top to receive the adjustable arms 28 and 30. Each of arms 28 and 30 is a generally U-shaped member with an armrest portion 64 and a pair of legs 66 that extend generally downward from the rest 64, near opposing ends of the rest 64. The armrest legs 66 are sized slightly smaller than the base legs 50 for close clearance, sliding engagement of the armrest legs 66 inside the base legs 50. Optionally, a tray 67 or the like may be incorporated into the arms 28 or 30 (FIGS. 17, 18, and 20–22).

Retractable casters 68 are provided in the base 22 to move the dialysis seating unit 20. Because the seating unit 20 may need to be moved when occupied by a patient, a powered extension mechanism is most preferably used to extend the casters 68 from a retracted position to an extended position. Manually actuated extension of the casters 68 may also be used. Alternatively, fixed position casters may be used. One of ordinary skill in the art will also understand that the casters 68 may conveniently be operated between the extended and the retracted positions with the use of a bell-crank and lever assembly that is actuated by a power cylinder, or the like, with the power cylinder being connected with and controlled by the pump 60, discussed in greater detail above.

Figure 2:
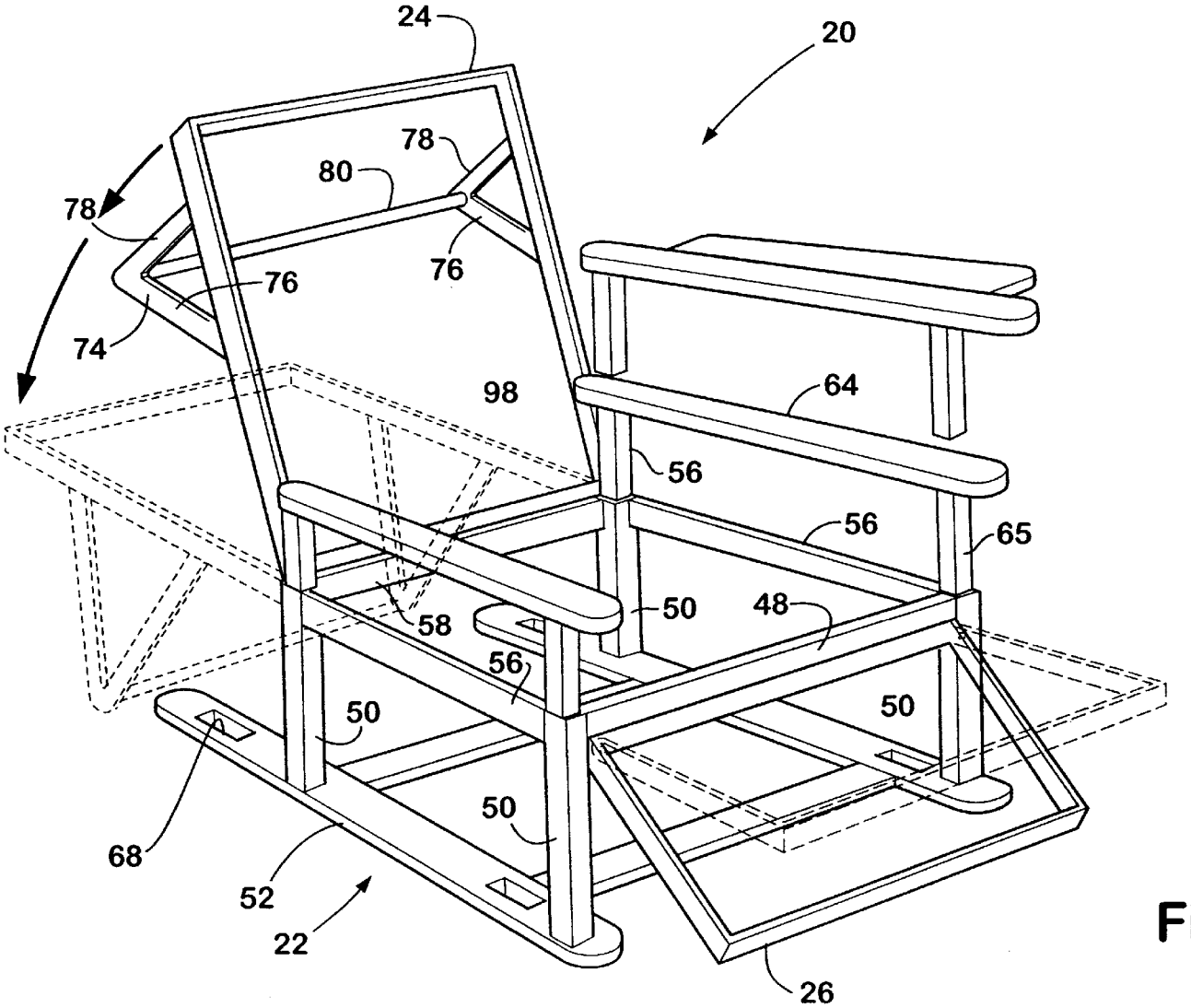
FIG. 2 is a perspective view of a frame for the seating unit of FIG. 1.
Figure 8:
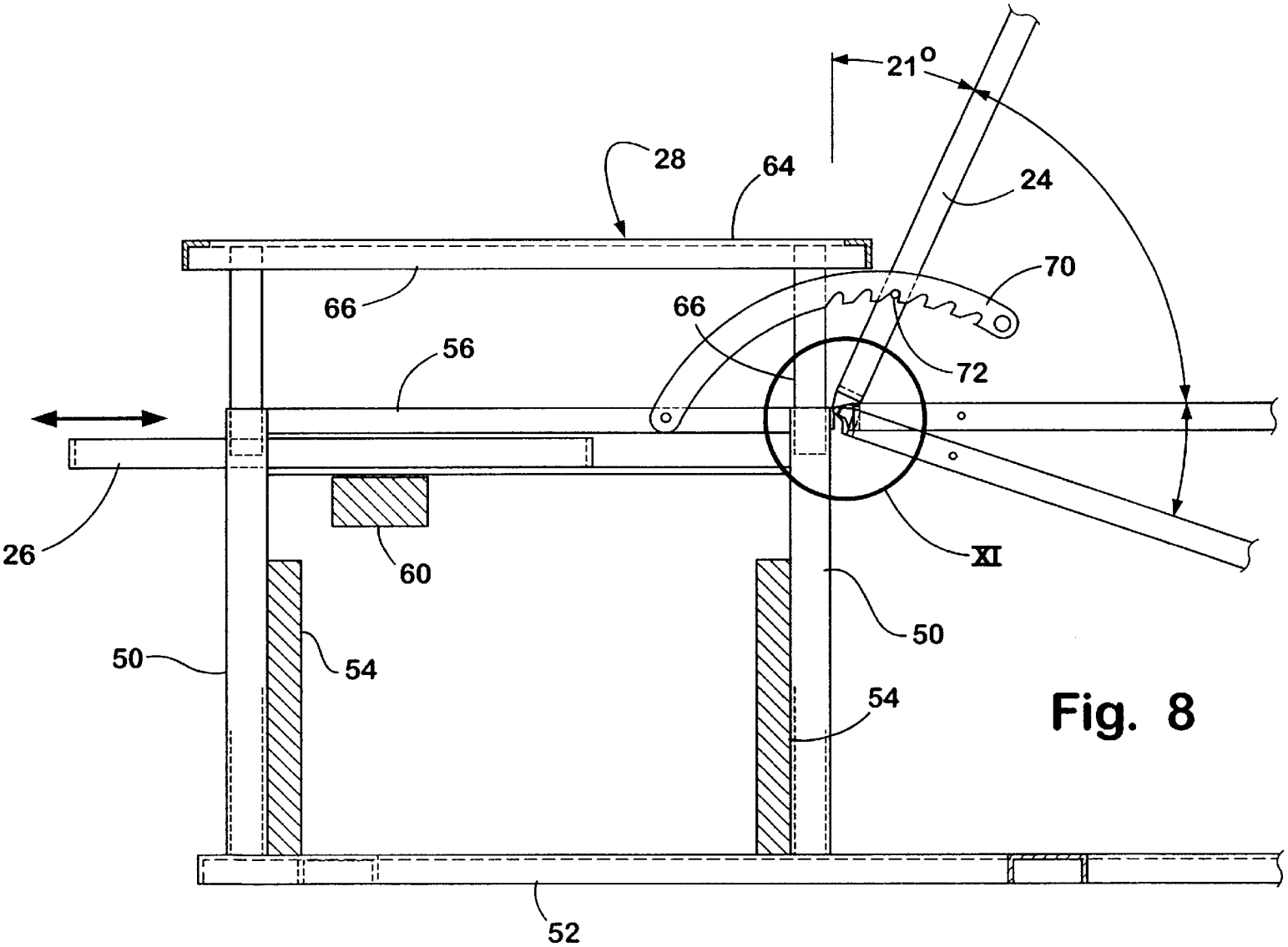
FIG. 8 is a fragmentary side elevational view of the frame of FIG. 2.
Figure 9:
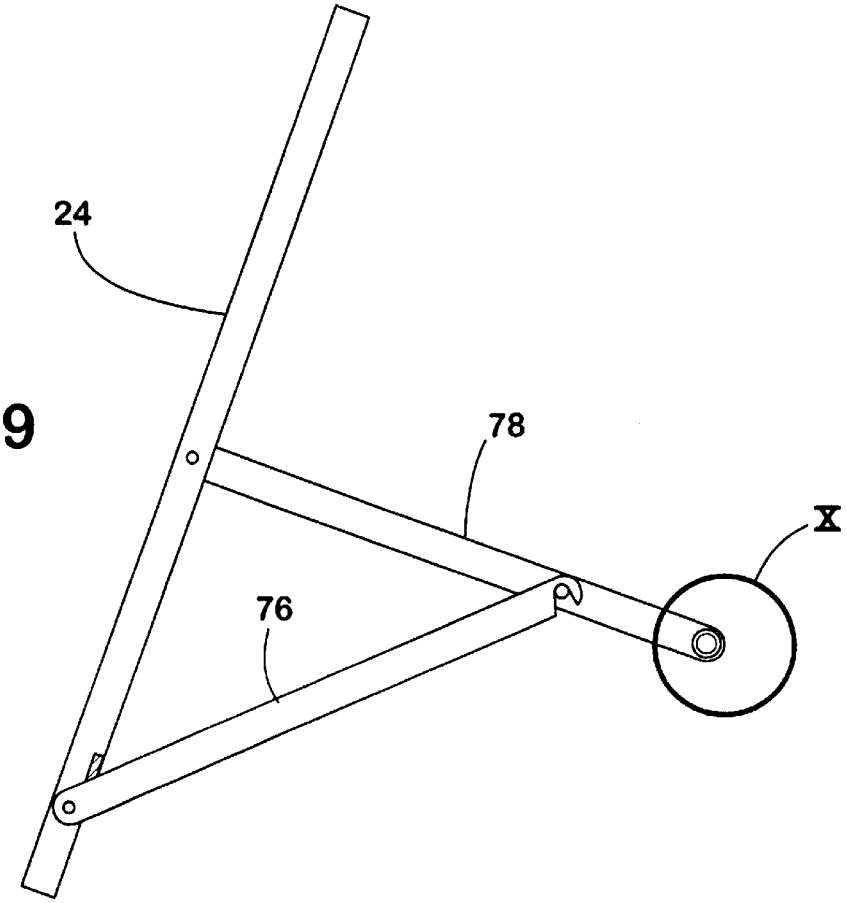
FIG. 9 is a fragmentary side elevational view of the back support of the frame of FIG. 2.
Figure 11:
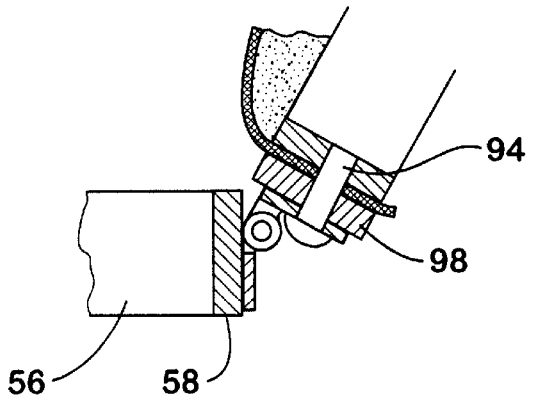
FIG. 11 is an enlarged, fragmentary, side elevational view of the detail XI of FIG. 8.
Figure 10:
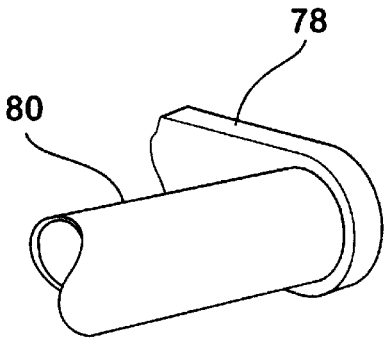
FIG. 10 is an enlarged perspective view of the detail X of FIG. 9.
Figure 12:
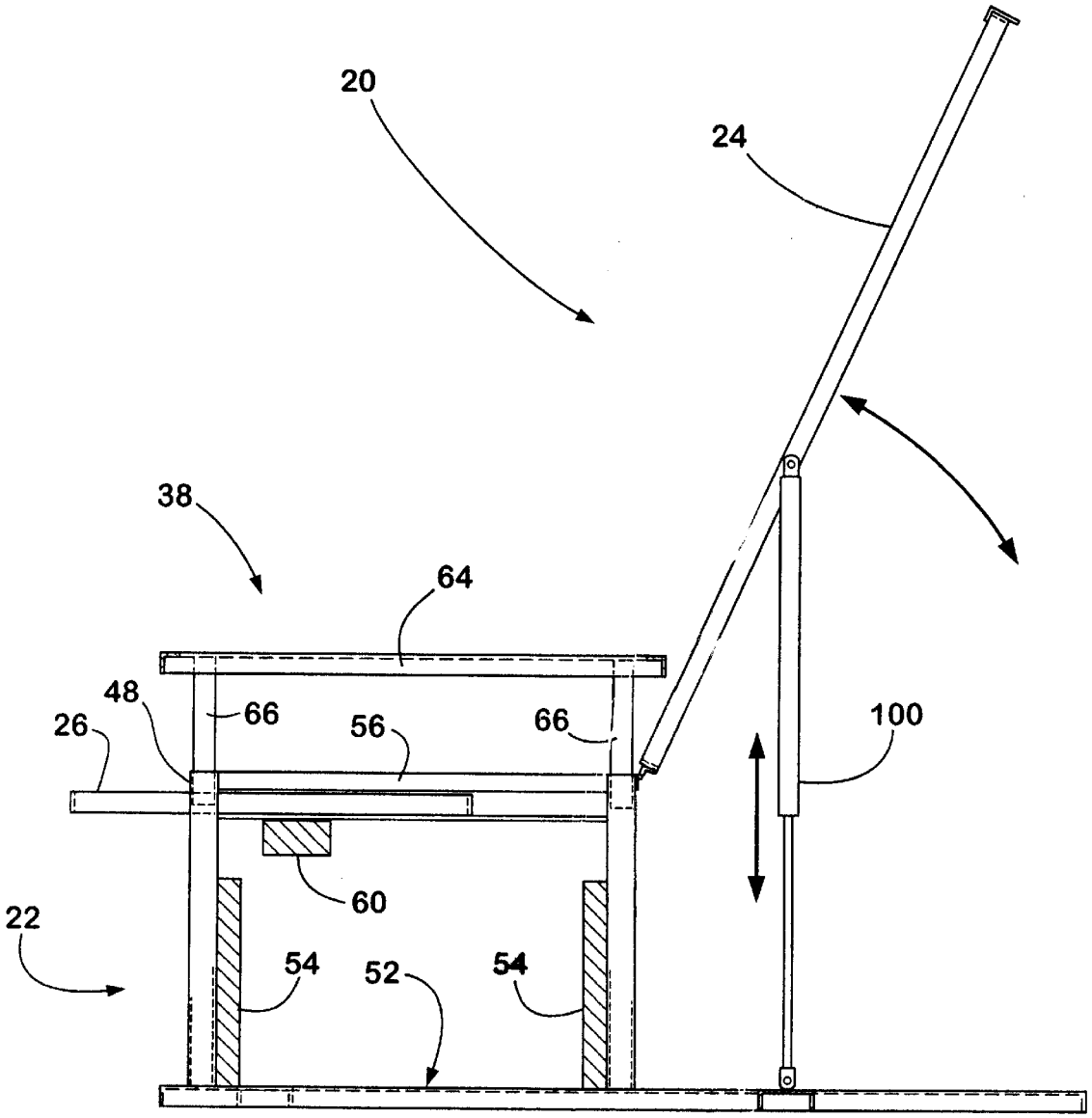
FIG. 12 is the side elevational view of the frame of FIG. 2, showing a first alternative back support reclining structure.
Figure 13:
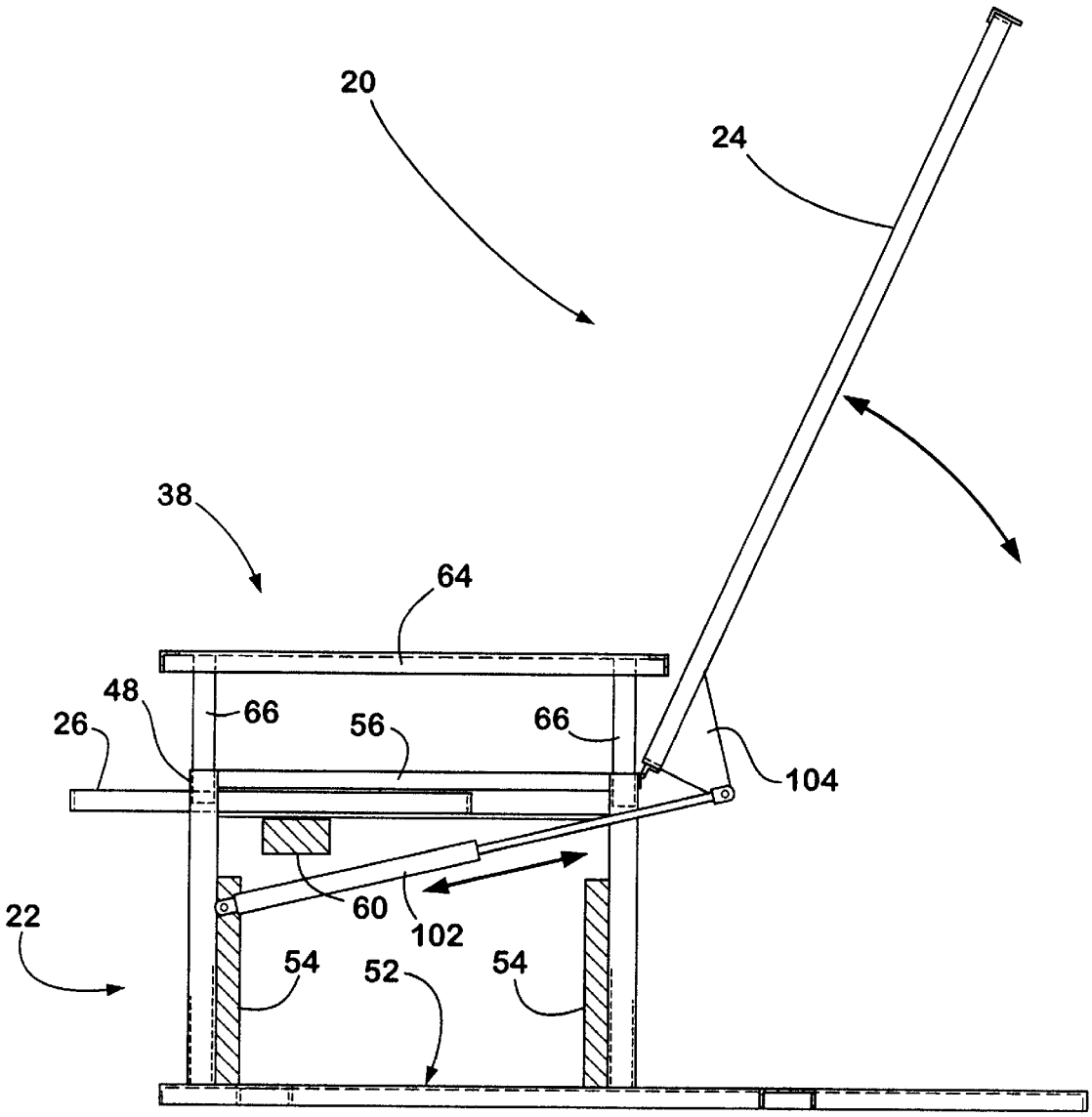
FIG. 13 is the side elevational view of FIG. 12, showing a second alternative back support reclining structure.

The leg rest support 26 is mounted to the base 22 under the front transverse brace 48 in sliding and pivoting attachment to the base 22, as will be understood by one having ordinary skill in the art. Thus, the leg rest support 26 may be elevated and slid under front transverse brace 48 for storage. Leg rest support 26 may also slide to extend outward from the base 22 and be pivoted downward for use (FIGS. 1, 2, and 8). Depending upon the specific implementation of the invention and as is the case with the various other components of the Dialysis seating unit 20, the leg rest support 26 may be power or manually actuated. Further, the power actuation may include a controller that adjusts the leg rest support 26 according to a pre-selected program.

Figure 3:
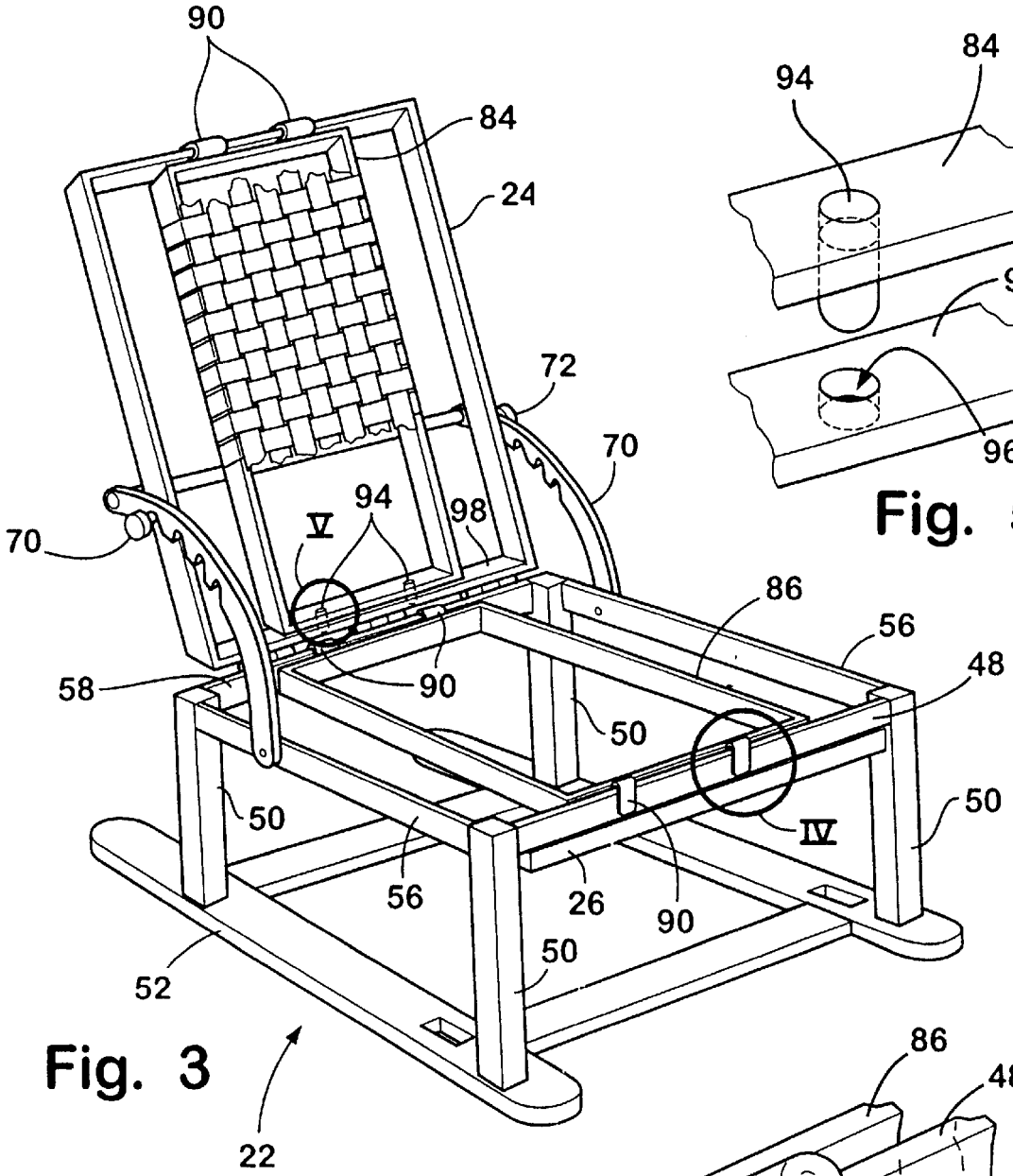
FIG. 3 is the view of FIG. 2, showing the placement of a back sizing frame and a seat sizing frame.
Figure 5:
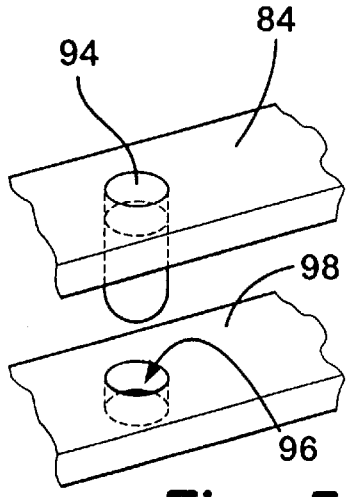
FIG. 5 is an enlarged, fragmentary, perspective view of the detail V of FIG. 3.

The back support 24 is hingedly connected with the back transverse brace 58 and is provided with ratchet stop arms 70, ratchet pins 72 that extend outward from back support 24 (FIGS. 1, 3, and 8), and back support stand 74 (FIGS. 1 and 2) as are commonly known in lounge chairs and the like (FIGS. 1, 3, and 8). The back support 24 is held in an upright and several reclined positions by stop arms 70 engaging pin 72. With stand 74 extended, back support 24 may be fully reclined to a horizontal position in which it is supported above a floor by the stand 74 as shown in FIGS. 1 and 2. As seen in drawing FIG. 9, stand 74 includes bracing legs 76 and main stand legs 78. Each of the bracing legs 76 and main stand legs 78 are pivotally attached to the back support 24. The bracing legs 76 are also releasably connected with main stand legs 78. Thus, the back support stand 74 may be folded to minimize space when stand 74 is not used. To add stability to the stand 74, a cross bar 80 interconnects the ends of the legs 78.

To make the seating unit 20 suitable and comfortable to use, the seat pad 32 is applied to base 22 and connected with the base 22 by conventional methods. Similarly, the back pad 34 is attached to the back support 24, the arm pads 38 and 40 are connected with the arm frames 28 and 30, respectively, and the leg rest pad 36 is connected with the leg rest support 26. Depending upon the specific implementation of the invention, the leg rest pad 36 may need to be removed to allow the leg rest support 26 to slide under the front transverse brace 48 and into the retracted position, described in greater detail above.

Figure 14:
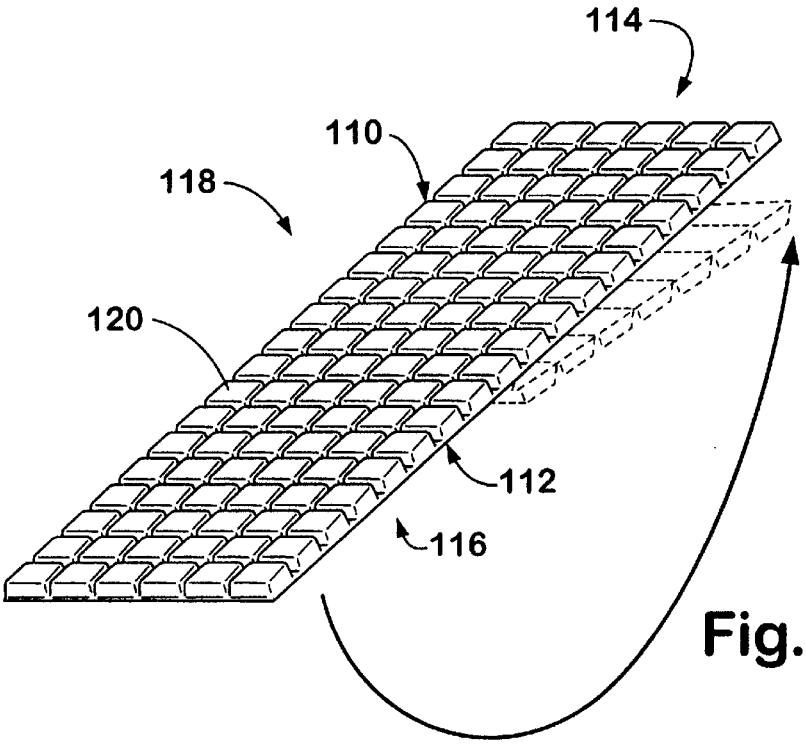
FIG. 14 is a perspective view of a single layer pad insert, showing the two layer, overlay construction according to the invention, in phantom.
Figure 15:
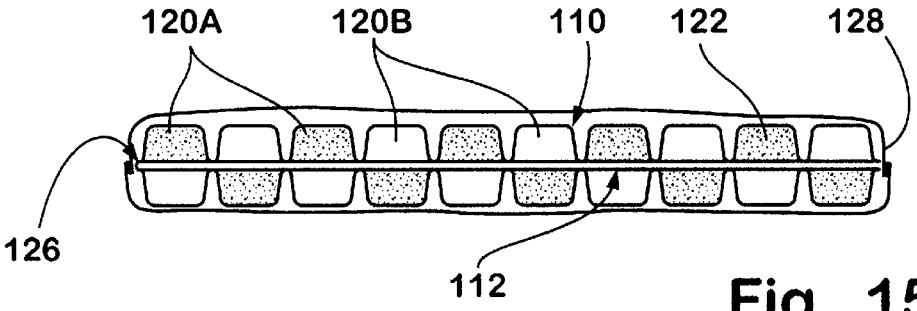
FIG. 15 is a schematic, cross-sectional view of a pad.

More particularly, each of the seating unit pads 32–40 is most preferably fabricated with a unique, two layer, overlay construction (FIGS. 14 and 15). A box quilt type construction is used in which a precut piece of fabric 110 is stitched or otherwise attached by methods commonly known in the fabric industries, to a second, smaller piece of precut fabric 112, resulting in a box-quilted, single layer pad insert 114 that has a smooth first side 116 and an opposing second side 118 with a grid pattern array of compartments 120 projecting from the second side. An all cotton or a cotton and spandex blend, light weight, upholstering fabric, which are commonly available, work well to keep a user dry and comfortable.

When the two pieces of fabric 110 and 112 are stitched together as just described above, the compartments are stuffed with a pad filling 122 as they are formed. Most preferably, every other one of the array of compartments 120 is stuffed with the pad filling, resulting in a checker board pattern of stuffed 120A and empty 120B compartments. Any suitable pad filling, commonly known in the upholstering fields, may be used. Most preferably, a light nylon netting that is commonly known for making cleaning scrubbing pads for example, works well for pad stuffing. A precut sheet of nylon netting may be crumpled, not folded, and stuffed into the compartments to provide a light weight and resilient pad insert that minimizes trapping perspiration against a user and that launders well.

After a single layer pad insert is made as described above, it is folded in half (FIG. 14) and fastened together to make a two layer, overlay pad insert 126 (FIG. 15). The two layer, overlay pad insert is covered with a pad cover 128, which may be made of any suitable upholstery fabric, including an all cotton terry cloth for example.

Figure 16:
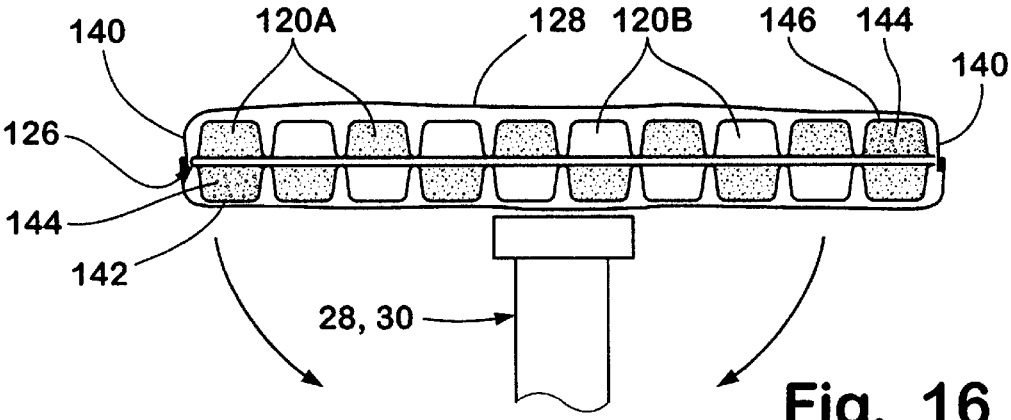
FIG. 16 is a schematic, cross-sectional view of an arm rest pad.
Figure 17:
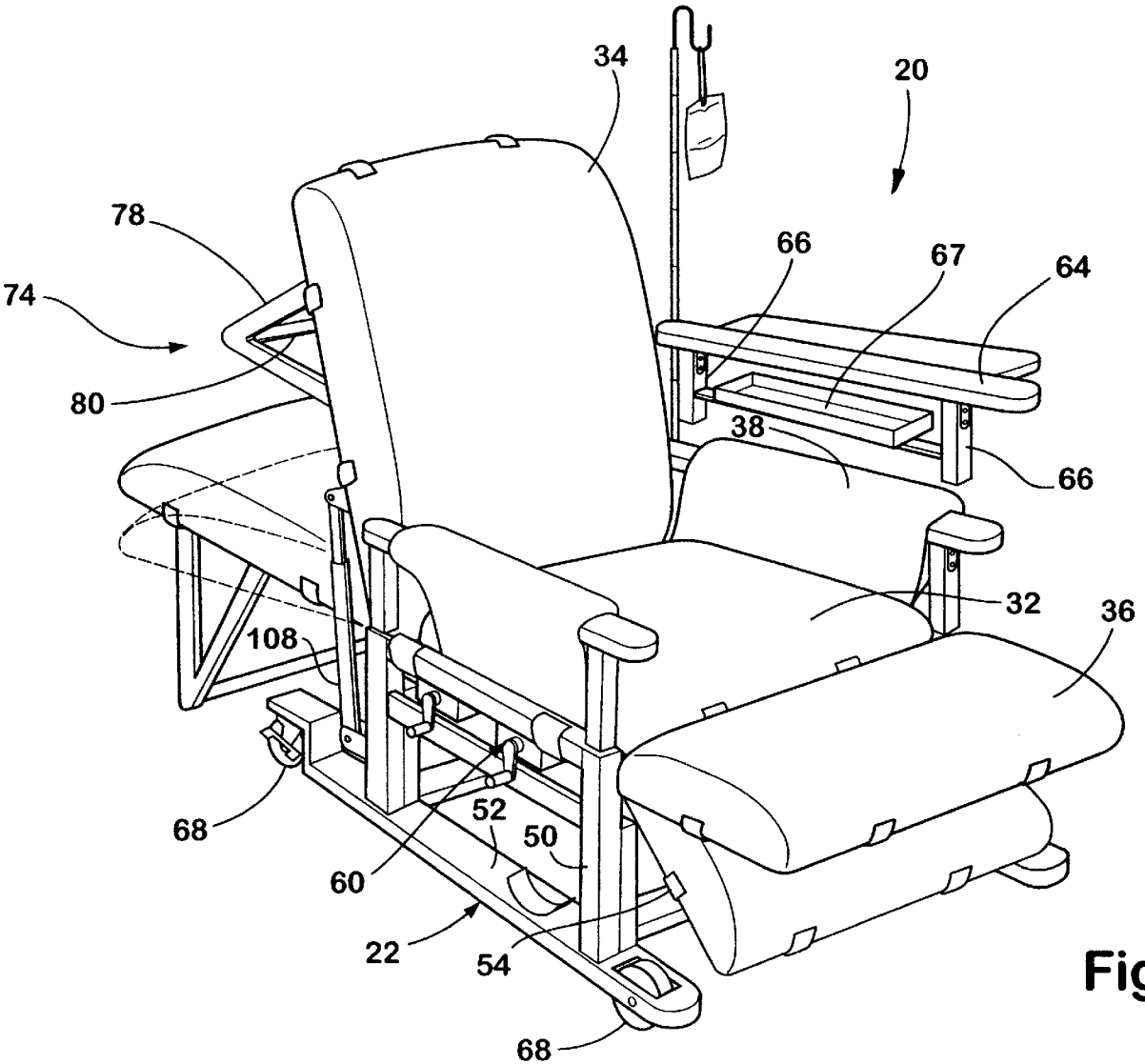
FIG. 17 is a perspective view of a first alternative embodiment of a seating unit according to the invention.
Figure 18:
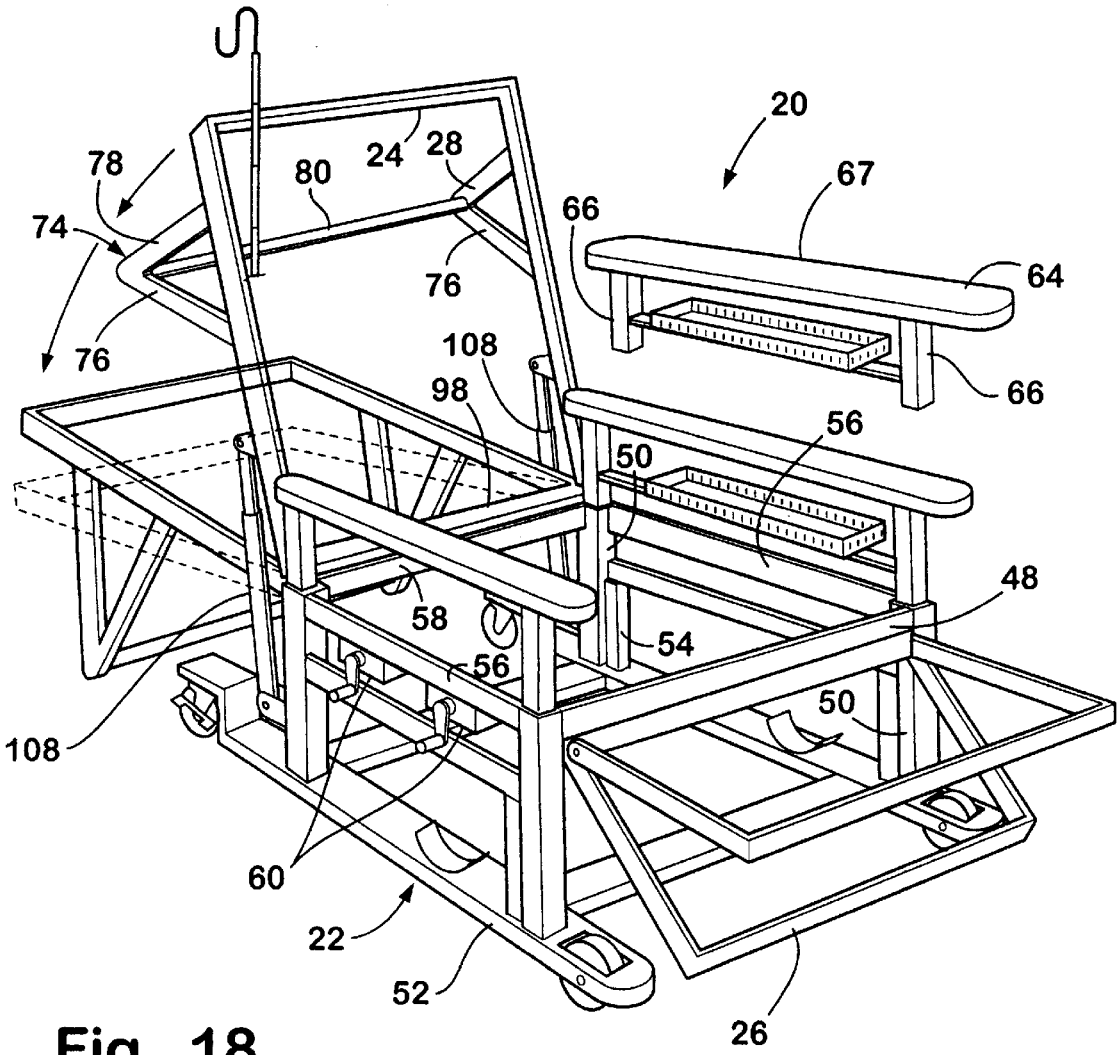
FIG. 18 is a perspective view of a frame for the seating unit of FIG. 17.

In contrast to the other pads, the arm pads 38 and 40 may be draped over the arms 28 and 30 (FIG. 16). Thus, the downward extending edges 140 of the arm pads 38 and 40 may be weighted to hold the pads in place. Weighting of the downward extending edges of the arm pads 38 and 40 is conveniently accomplished by filling the otherwise empty edge compartments 142 of the pad insert 126 with suitable weights 144. The plastic pellets that are commonly used in the toy industry to fill bean bag type toys work well to weight the arm pads 38 and 40. These plastic pellets are non-toxic and heat resistant, so they wash well.

The basic framework of the seating unit 20 is most preferably constructed with dimensions and proportions that are quite generous to accommodate the largest of dialysis patients who may use the seating unit. This may, however, provide an overly large seating unit for smaller patients. Thus, oversized arm pads 38 and 40 may be provided to effectively narrow the seating area. Also, the invention is provided with a back support insert 84 and a seat insert 86 to effectively narrow the frame of the seating unit 20. Each of the back support insert 84 and seat insert 86 has a box frame construction with a basket weave fabric overlay (FIG. 3). A nylon web strap that is similar to automotive seat belt nylon web strapping, may, for example, be used to weave the supporting basket weave fabric overlay.

Figure 4:
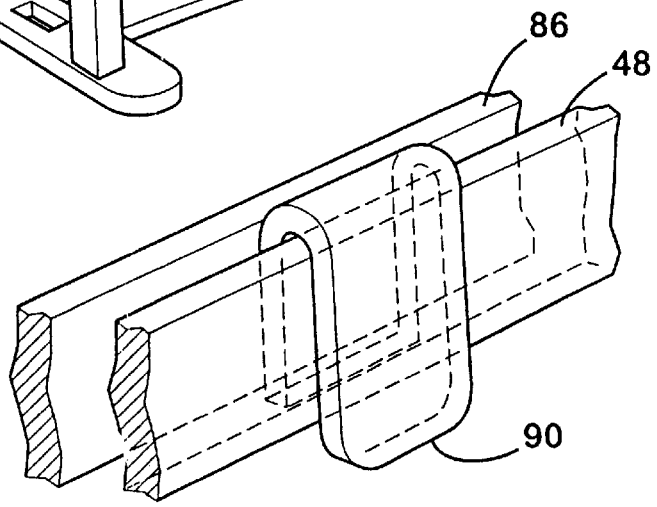
FIG. 4 is an enlarged, fragmentary, perspective view of the detail IV of FIG. 3.

The seat insert 86 is supported on the front and back transverse braces 48 and 58, respectively, by two pair of hooks 90 (FIG. 3 and 4). Similarly, the back support insert 84 is provided with a pair of hooks 92 at a top member of the back support insert. At the bottom of the back support insert 84, a pair of pins 94 extend from the back support insert and engage cooperating pin holes 96 that are located in a lower member 98 of the back support 24. An array of pin holes 96 may be provided so the back support insert 84 can be located in a number of positions relative to the back support 24.

In a first alternative embodiment of the back support recliner mechanism (FIG. 12), the back support 24 is connected with the base 22 by at least one power cylinder 100 to provide power actuated reclining of the seat back. The power cylinder 100 may also be connected with and controlled by the pump 60, discussed in greater detail above.

In a second alternative embodiment of the back support recliner mechanism (FIG. 13) a power cylinder 102 is connected with the back support 24 by a crank bracket 104. The power cylinder 102 may also be connected with and controlled by the pump 60, discussed in greater detail above.

Figure 19:
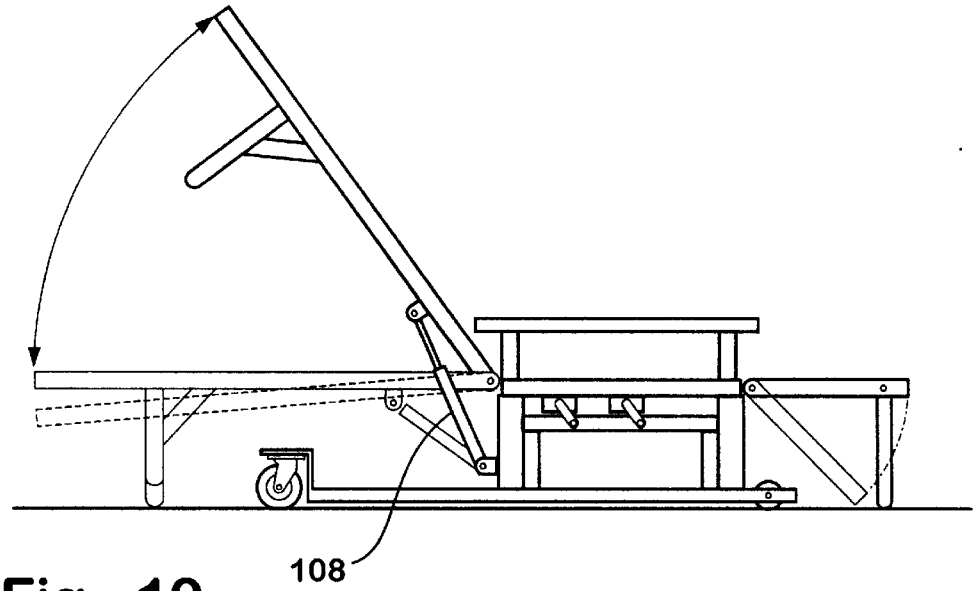
FIG. 19 is a side elevational view thereof.
Figure 22:
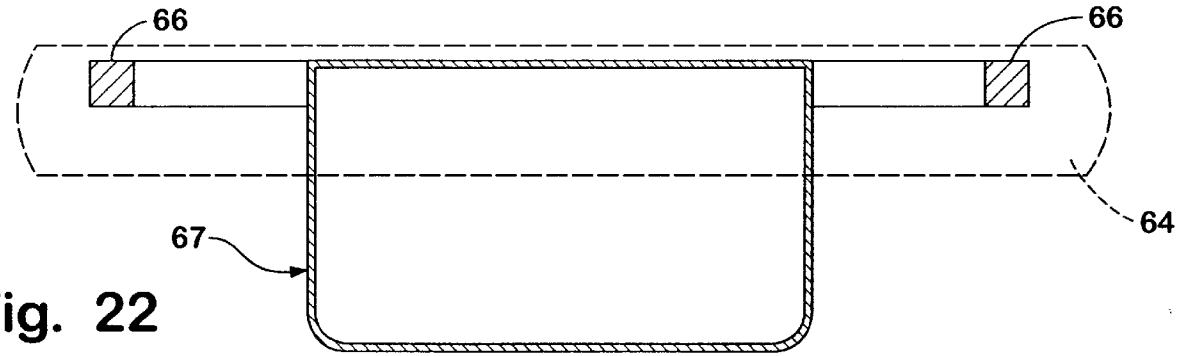
FIG. 22 is a cross-sectional view thereof, along section line XXII—XXII of FIG. 21.
Figure 21:
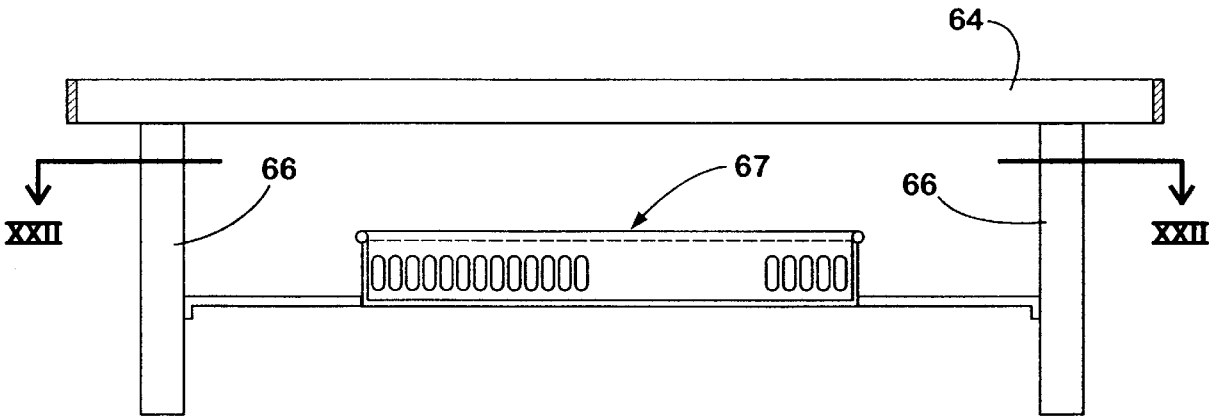
FIG. 21 is a side elevational view thereof.
Figure 20:
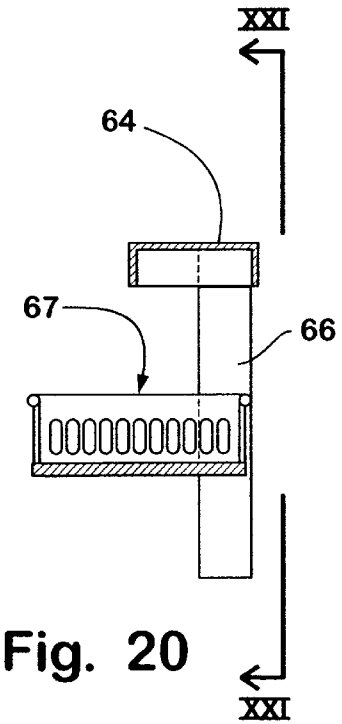
FIG. 20 is an end elevational view of an arm frame thereof.

In yet a third alternative embodiment of the back support recliner mechanism (FIGS. 17–19), the back support 24 is connected with the base 22, more particularly attached to the back legs 50, by a pair of power cylinders 108 to provide power actuated reclining of the seat back. The power cylinder 108 may also be connected with and controlled by the pump 60, discussed in greater detail above.

Finally, it will be understood by one having ordinary skill in the art that the basic, motivating energy source to power the various power actuated components that may be incorporated into a dialysis seating unit 20 according to the invention, may be sourced from a standard electrical connection between the seating unit and a convenient wall outlet, for example. Alternatively, the seating unit 20 may be self contained with an "on-board" battery that may be either a primary power source or a back-up to the standard electrical connection as mentioned above.

It will be understood by one having ordinary skill in the art and by those who practice the invention, that various modifications and improvements may be made without departing from the spirit of the disclosed concept. The scope of protection afforded is to be determined by the claims and by the breadth of interpretation allowed by law.

I claim:

1. A dialysis seating unit comprising:

a base having a seat to receive and support a buttocks of a user;

a back support connected with said base to receive and support at least a portion of a back of the user; and a pad interposed between the user and at least one of said seat and said back support, said pad having a shell defining an array of compartments and having pad filling in every other one of said array of compartments to define an alternating pattern of filled and empty compartments.

2. The dialysis seating unit of claim 1 wherein the seat has a seat frame and the back support has a back frame, and wherein the at least one of the seat and the back support further has an insert that couples with the respective frame to adapt a size of the respective frame to a preselected size, the insert further supporting the pad.

3. The dialysis seating unit of claim 2 wherein the base further includes a number of legs that telescope to adjust a height of the seat to a preselected height for use by the user.

4. The dialysis seating unit of claim 3 wherein the pad is a double layer pad, including first and second pad portions, each pad portion having a shell defining an array of compartments and having pad filling in every other one of the compartments to define an alternating pattern of compartments that have pad filling and that are empty, the first pad portion overlaying the second pad portion and being oriented with respect to the second pad portion so the compartments of the first pad portion that have pad filling overlay the empty compartments of the second pad portion.

5. The dialysis seating unit of claim 4 wherein the pad filling is a non-absorbent mesh material.

6. The dialysis seating unit of claim 1 wherein the pad is a double layer pad, including first and second pad portions, each pad portion having a shell defining an array of compartments and having pad filling in every other one of the compartments to define an alternating pattern of compartments that have pad filling and that are empty, the first pad portion overlaying the second pad portion and being oriented with respect to the second pad portion so the compartments of the first pad portion that have pad filling overlay the empty compartments of the second pad portion.

7. The dialysis seating unit of claim 6 wherein the pad filling is a non-absorbent mesh material.

8. The dialysis seating unit of claim 1 wherein the pad filling is a non-absorbent mesh material.

9. A dialysis seating unit comprising:

a base having a seat frame;

a back frame hingedly connected with said base to pivot between raised and lowered positions;

a back support insert that releasably couples with said back frame to adapt said back support to a preselected size;

a seat insert that releasably couples with said seat frame to adapt said seat frame to a preselected size; and a pad supported by one of the back support insert and the seat insert.

10. The dialysis seating unit of claim 9 wherein the base further includes a number of legs that telescope to adjust a height of the seat to a preselected height for use by the user.

11. The dialysis seating unit of claim 10 wherein the pad has a shell defining an array of compartments and has pad filling in every other one of the compartments to define an alternating pattern of compartments that have pad filling and that are empty.

12. The dialysis seating unit of claim 11 wherein the pad is a double layer pad, including first and second pad portions, each pad portion having a shell defining an array of compartments and having pad filling in every other one of the compartments to define an alternating pattern of compartments that have pad filling and that are empty, the first pad portion overlaying the second pad portion and being oriented with respect to the second pad portion so the compartments of the first pad portion that have pad filling overlay the empty compartments of the second pad portion.

13. The dialysis seating unit of claim 12 wherein the pad filling is a non-absorbent mesh material.

14. The dialysis seating unit of claim 9 wherein the pad has a shell defining an array of compartments and has pad filling in every other one of the compartments to define an alternating pattern of compartments that have pad filling and that are empty.

15. The dialysis seating unit of claim 14 wherein the pad is a double layer pad, including first and second pad portions, each pad portion having a shell defining an array of compartments and having pad filling in every other one of the compartments to define an alternating pattern of compartments that have pad filling and that are empty, the first pad portion overlaying the second pad portion and being oriented with respect to the second pad portion so the compartments of the first pad portion that have pad filling overlay the empty compartments of the second pad portion.

16. The dialysis seating unit of claim 15 wherein the pad filling is a non-absorbent mesh material.

17. A dialysis seating unit comprising:

a seat frame;

a plurality of legs extending generally downward from the seat frame to support the seat frame above a floor;

a seat member defining a seat having a predetermined size, and releasably coupled with and supported by the seat frame;

a seat pad removably supported by the seat member;

a back frame hingedly connected with the seat frame to pivot between upright and relined positions;

a back member defining a back having a predetermined size, and releasably coupled with and supported by the back frame; and a back pad removably supported by the back member.

18. The dialysis seating unit of claim 17 wherein the pad has a shell defining an array of compartments and has pad filling in every other one of the compartments to define an alternating pattern of compartments that have pad filling and that are empty.

19. The dialysis seating unit of claim 18 wherein the pad is a double layer pad, including first and second pad portions, each pad portion having a shell defining an array of compartments and having pad filling in every other one of the compartments to define an alternating pattern of compartments that have pad filling and that are empty, the first pad portion overlaying the second pad portion and being oriented with respect to the second pad portion so the compartments of the first pad portion that have pad filling overlay the empty compartments of the second pad portion.

20. The dialysis seating unit of claim 19 wherein the legs telescope to adjust a height of the seat to a preselected height for use by the user.

* * * * *